United States Patent [19]

Pittman et al.

[11] Patent Number: 5,064,140

[45] Date of Patent: Nov. 12, 1991

[54] COVERT MILLIMETER WAVE BEAM PROJECTOR

[75] Inventors: William C. Pittman; Walter E. Miller, Jr.; Michael R. Christian, all of Huntsville, Ala.

[73] Assignee: The United States of America as represented by the Secretary of the Army, Washington, D.C.

[21] Appl. No.: 594,506

[22] Filed: Oct. 9, 1990

[51] Int. Cl.[5] ..... F41G 7/24; F41G 7/28

[52] U.S. Cl. ..... 244/3.13; 244/3.14

[58] Field of Search ..... 342/62; 244/3.13, 3.14, 244/3.16, 3.19

[56] References Cited

U.S. PATENT DOCUMENTS

| | | | |
|---|---|---|---|
| H299 | 7/1987 | Miller, Jr. | 244/3.13 |
| H628 | 4/1989 | McIngrale | 342/33 |
| 2,908,002 | 10/1959 | Van Atta | 342/5 X |
| 3,182,930 | 5/1965 | Randolph, Jr., et al. | 342/43 X |
| 3,736,592 | 5/1973 | Coleman | 342/370 |
| 3,754,257 | 8/1973 | Coleman | 342/370 |
| 3,757,335 | 9/1973 | Gruenberg | 342/367 |
| 3,789,417 | 1/1974 | Coleman | 342/373 X |
| 3,803,618 | 4/1974 | Coleman | 342/373 X |
| 3,856,237 | 12/1974 | Torian et al. | 342/62 X |
| 3,958,246 | 5/1976 | Wohlers et al. | 342/6 X |
| 4,097,007 | 6/1978 | Fagan et al. | 244/3.11 |
| 4,100,545 | 7/1978 | Tabourier | 342/62 |
| 4,234,141 | 11/1980 | Miller, Jr.; et al. | 244/3.13 |
| 4,243,187 | 1/1981 | Esker | 244/3.13 |
| 4,247,059 | 1/1981 | Duke et al. | 244/3.16 |
| 4,256,275 | 3/1981 | Flick et al. | 244/3.19 |
| 4,441,669 | 4/1984 | Wich | 244/3.13 |
| 4,501,399 | 2/1985 | Loomis, III | 244/3.13 |
| 4,516,743 | 5/1985 | Sweeney et al. | 244/3.13 |
| 4,676,455 | 6/1987 | Diehl et al. | 244/3.13 |
| 4,732,349 | 3/1988 | Maurer | 244/3.13 |
| 4,806,938 | 2/1989 | Meadows | 342/370 |
| 4,985,707 | 1/1991 | Schmidt et al. | 342/370 |

OTHER PUBLICATIONS

"Self-Phased Arrays" by Donald L. Margerum, Chapter 5 in *Microwave Scanning Antennas,* vol. III, R. C. Hansen (editor), Academic Press, New York and London (1966), pp. 366–372.

"Phase Conjugation: Techniques and Applications" by Concetto R. Giuliano and David A. Rockwell in *Physics of New Laser Sources,* N. B. Abraham et al., (editors) Plenum Press, New York and London (1984), pp. 381–409.

*Primary Examiner*—John B. Sotomayor

*Attorney, Agent, or Firm*—Freddie M. Bush; Hay Kyung Chang

[57] ABSTRACT

Van Atta array is used to receive a millimeter wave beam from a beam transmitter located in a missile in flight and retransmit the beam back to its source along its original optical path after the beam is phase conjugated and modulated at a tracking station by imparting to it missile guidance information. The missile extracts guidance information from the retransmitted beam and guides its trajectory closer to the course leading to the target.

2 Claims, 2 Drawing Sheets

COVERT MILLIMETER WAVE BEAM PROJECTOR

DEDICATORY CLAUSE

The invention described herein may be manufactured, used, and licensed by or for the Government for governmental purposes without the payment to us of any royalties thereon.

BACKGROUND OF THE INVENTION

A retrodirective reflecting device is one which is capable of receiving an electromagnetic signal and retransmitting it to the source from whence it came. Retrodirectivity, that is, the capability of a device to have an outgoing wave travel in a direction exactly opposite that of the incoming wave, is the basis for a covert beam projector described in Statutory Invention Registration (SIR) H299, July 7, 1987. The covert beam projector described in SIR H299 utilizes the principle of phase conjugation in the optical region of the spectrum to achieve retrodirectivity. However, phase conjugation can also be achieved in the microwave and millimeter wave regions with the use of Van Atta array. Van Atta array is the subject of U.S. Pat. No. 2,908,002 and one-dimensional version of the array is shown in FIG. 1. The essential characteristic of a Van Atta array is that the transmission lines, 2, 4, 6, connecting each pair of antenna elements 8, 10, 12 respectively, cause the same phase delay in the electromagnetic wave in the pairs of antenna elements. Each antenna element in a pair is equidistant from the geometric center of the array. Under the equal delay principle, if the incoming wave is tilted so that it is incident first on the elements to the right of the center, the wave, through the equal delay transmission lines, will be retransmitted through the elements to the left of the center. Thus, the advanced signals on reception are retransmitted as delays, and vice versa. Hence, the sum of the retransmitted signals add coherently in the direction of the original signal source, expressed $$E_{rt} = \sum_{i=-N/2}^{N/2} \exp j\left[\omega t + \frac{2\pi X_i^{(r)}}{\lambda}\sin\theta_r + \phi_L + \frac{2\pi X_i^{(t)}}{\lambda}\sin\theta_t\right]$$

where $E_{rt}$ is the resultant retransmitted field, $X_i^{(r)}$ is the displacement of the $i^{th}$ receiving element from the array center, $X_i^{(t)}$ is the displacement of the transmitting element from the array center, $\theta_r$ = the received angle of arrival from broadside, $\theta_t$ = the retransmitted angle which is an independent variable, $\phi_L$ = the common interconnecting line phase delay $\lambda$ = wavelength of the beam $\omega$ = frequency of the beam t = time Bidirectional amplifiers 14, 16, 18 may be included as shown in FIG. 1 in the transmission lines, but the phase delay through each amplifier must be exactly the same.

Several such line arrays can be combined to provide a circularly symmetrical array as shown in FIG. 2. In this array, retrodirective transmission is preserved regardless of the angle of incidence of the incoming wave on the array. For the sake of simplicity, the connecting transmission lines and the amplifiers are not shown.

SUMMARY OF THE INVENTION

By using a millimeter wave source for projecting a millimeter wave beam from the rear of a missile generally toward a receiver at the tracking station and by retransmitting the phase conjugate of the beam back to the missile from whence the millimeter wave beam originated, a covert beam projector capability in the millimeter wave region is provided where missile guidance systems are less susceptible to smoke and weather conditions. Further, the narrow retrodirectivity characteristic of phase conjugate beams make enemy interception of the re-transmitted beam much less probable.

DESCRIPTION OF THE PREFERRED EMBODIMENT

Figure 1:
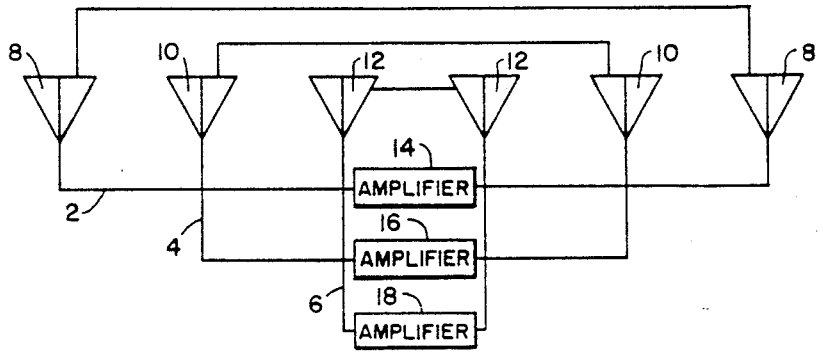
FIG. 1 (PRIOR ART)
FIG. 1 shows a typical one-dimensional Van Atta array.
Figure 2:
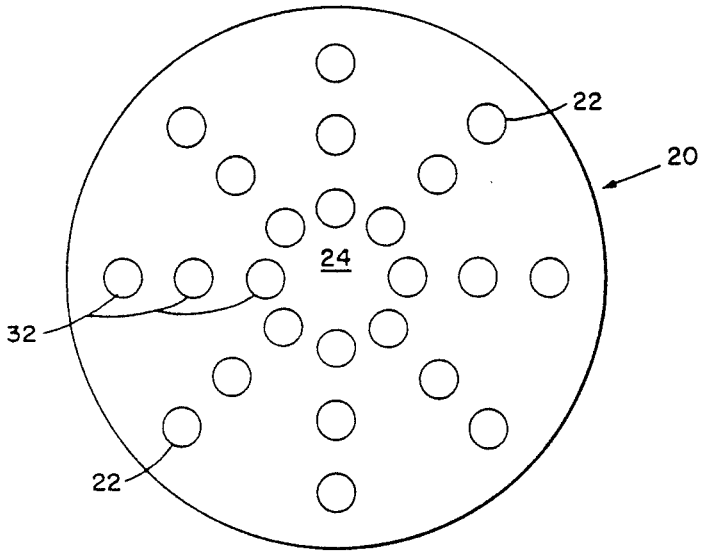
FIG. 2 (PRIOR ART)
FIG. 2 depicts a two-dimensional circular Van Atta array. Transmission lines and amplifiers are not shown.
Figure 3:
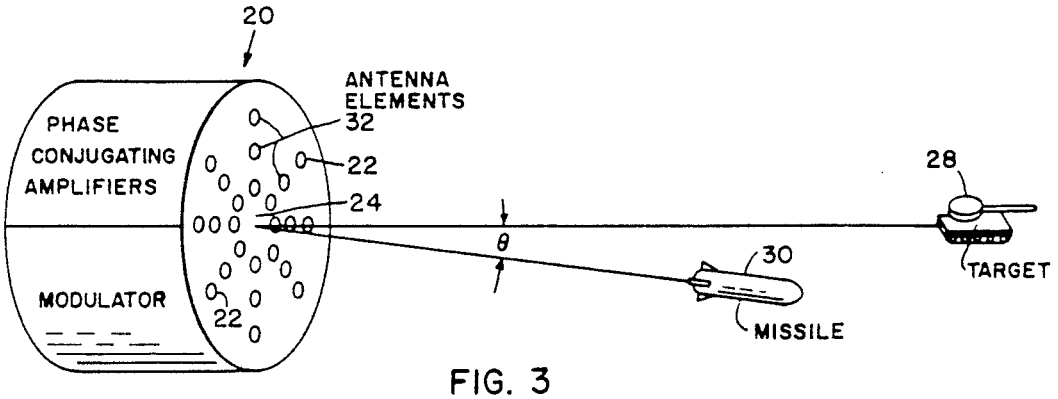
FIG. 3 shows the position of the circular Van Atta array relative to the target and the missile in the millimeter wave missile guidance system.
Figure 4:
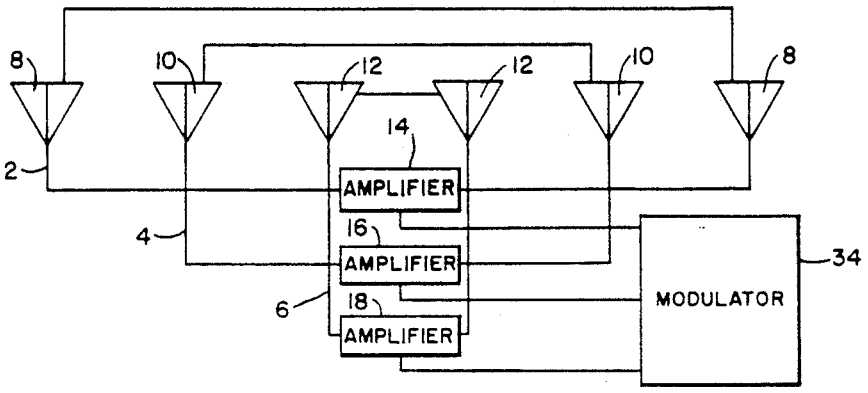
FIG. 4 shows modulator which imparts modulation to retransmitted signals suitable for missile guidance.
Figure 5:
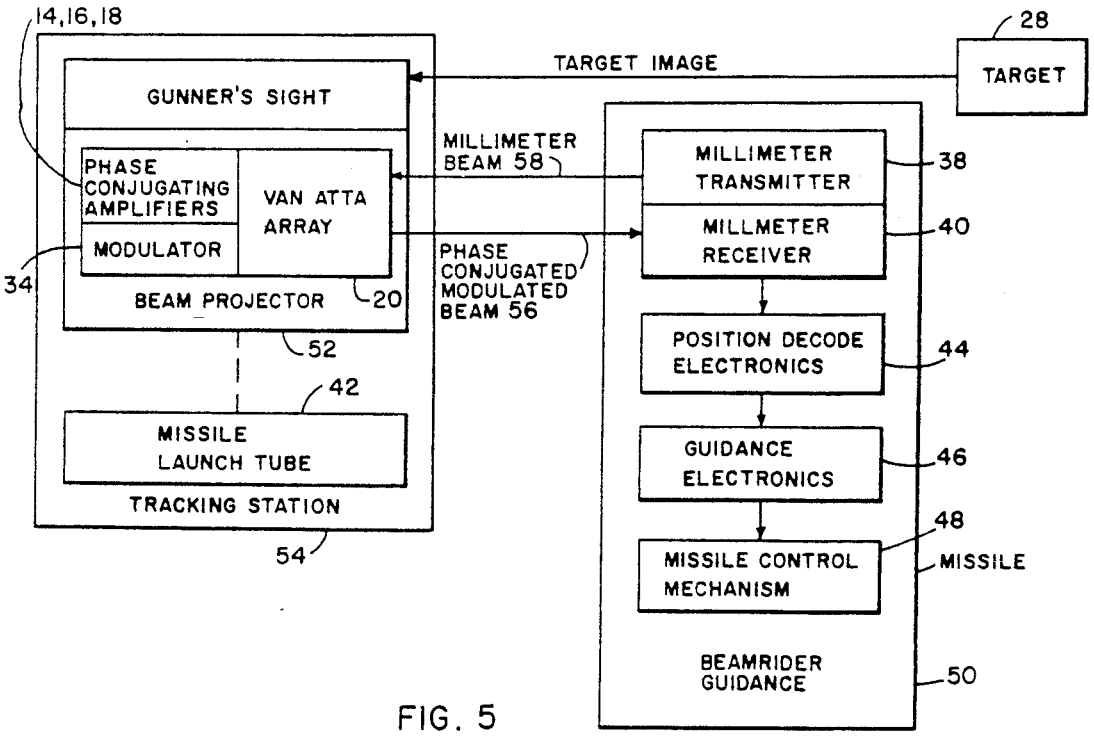
FIG. 5 is a block diagram of the millimeter wave missile guidance system of FIG. 3 and FIG. 4 for providing missile guidance through covert millimeter wave beam projection to the missile.

FIG. 1 and FIG. 2 have been explained in Background of the Invention. Referring now to drawings wherein like numbers refer to like parts, FIG. 3 which is a simplified depiction of the beam projector at the tracking station, in conjunction with FIG. 5, illustrates the overall millimeter wave missile guidance system. Van Atta array 20 is located in tracking station 54 and center 24 of the array is boresighted with the gunner's line of sight of target 28. Missile 30, during its flight, projects a millimeter wave beam that is generally directed toward tracking station 54 and illuminates antenna elements 32 of Van Atta array 20. The wave front phase differential between pairs of outer antenna elements such as elements 22 of the Van Atta array is a measure of the angular deviation of the missile's trajectory from the gunner's line-of-sight to the target. Based on this angular deviation of the missile in flight from the sight line, missile commands in the form of modulation are imparted to the retransmitted signal to the missile by modulator 34. Modulator 34 accomplishes this task by modulating amplifiers 14, 16, 18, as shown in FIG. 4. The modulation may be a subcarrier frequency proportional to the phase differential, a pulse width or a pulse position, the techniques of all of which are well known in the art and any of which may be accommodated by amplifiers associated with a Van Atta array. In pulse width modulation, for example, the amplifiers are off and on. When they are off, no retransmission occurs. The on-time may be greater than nominal for positive angular position and less than nominal for negative angular position.

FIG. 5 shows in detail the millimeter wave beam missile guidance system. While using gunner's sight to maintain the image of target 28 through the center of Van Atta array 20, the gunner launches missile 30 containing guidance 50 from missile launch tube 42. During the flight of the missile, millimeter wave transmitter 38 located at the rear of the missile projects millimeter wave beam 58 to Van Atta array located at tracking station 54. The phase differential between pairs of outer antenna elements is the angular deviation of the missile's trajectory from the gunner's line-of-sight to the target. The received millimeter wave beam is phase conjugated by a two-dimensional Van Atta array 20 utilizing bidirectional amplifiers 14, 16, 18 which are also modulated by modulator 34 coupled to the amplifiers. Modulation techniques which are well known in the art are used to impart missile guidance information to the beam. Phase conjugated modulated beam 56 is then retransmitted by Van Atta array 20 along the original optical path back to the missile where the beam is received by receiver 40 located adjacent to millimeter wave transmitter 38 at the rear of the missile. From receiver 40, the beam signal is input to position decoding electronics circuitry 44 which decodes the modulated beam and couples the decoded missile guidance information thus obtained to guidance electronics circuitry 46 to enable it to drive missile control mechanism 48 in accordance with well known method to adjust the missile trajectory to be closer to the line-of-sight and thus more accurately impact on target 28.

Although a particular embodiment and form of this invention has been illustrated, it is apparent that various modifications and embodiments of the invention may be made by those skilled the art without departing from the scope and spirit of the foregoing disclosure. Accordingly, the scope of the invention should be limited only by the claims appended hereto.

We claim:

1. A method for guiding a missile toward a target while the missile is in flight, comprising the steps of:

visually tracking a target from a target tracking station, issuing a millimeter wave beam from the missile in flight toward the tracking station, receiving the millimeter wave beam at the tracking station, performing amplification on the received beam at the tracking station, performing phase conjugation on the received beam at the tracking station, modulating the phase-conjugated amplified beam to impregnate said beam with angular offset of said beam from the line-of-sight of the target, redirecting the modulated beam along its original optical path back to the missile, receiving the redirected beam by the missile, and generating guidance signals in the missile in response to the received redirected beam to guide the missile in the direction to reduce said angular offset.

2. A missile guidance system for guiding a missile toward a tracked target, said system comprising:

a means on the missile for transmitting millimeter wave beam along an optical path; a two-dimensional Van Atta array, said array being suitably disposed to provide line-of-sight of the target, to receive the transmitted millimeter wave beam from the missile and to retransmit the beam back to the missile; a phase-conjugating means, said means being appropriately coupled to said array for receiving the transmitted beam from said array, performing phase conjugation on the beam and redirecting the phase conjugated beam to said array for retransmission to the missile; a device on the missile for receiving and decoding the retransmitted beam and a means on the missile for guiding the missile in response to the retransmitted beam.

* * * * *